US006106452A

United States Patent [19]

Baumuller

[11] Patent Number: 6,106,452

[45] Date of Patent: Aug. 22, 2000

[54] MACHINES AND METHODS FOR MAKING CUSHIONING DUNNAGE PRODUCTS BY CRUMPING PAPER

[75] Inventor: Théodore Baumuller, Schweighouse sur Moder, France

[73] Assignee: Naturembal S.A., Bourwiller, France

[21] Appl. No.: 08/426,468

[22] Filed: Apr. 19, 1995

[30] Foreign Application Priority Data

Apr. 22, 1994 [EP] European Pat. Off. ..... 94440027

[51] Int. Cl.[7] ..... B31D 5/00

[52] U.S. Cl. ..... 493/464; 493/967

[58] Field of Search ..... 493/967, 968, 493/271, 287, 288, 290, 302, 311, 454, 458, 464, 479, 354, 372, 381, 439, 440, 461, 462, 465

[56] References Cited

U.S. PATENT DOCUMENTS

| | | | |
|---|---|---|---|
| 2,786,399 | 3/1957 | Mason | 493/967 |
| 2,819,488 | 1/1958 | Gimbel | 452/24 |
| 3,164,069 | 1/1965 | Wilkie | 493/464 |
| 3,337,906 | 8/1967 | Kaluza | 452/24 |
| 3,398,223 | 8/1968 | Schatz | 493/464 |
| 3,509,798 | 5/1970 | Johnson | 493/967 |
| 3,540,076 | 11/1970 | Urbutis | 452/21 |
| 3,603,216 | 9/1971 | Johnson | 493/967 |
| 3,650,877 | 3/1972 | Johnson | 493/967 |
| 3,655,500 | 4/1972 | Johnson | 493/464 |
| 3,717,074 | 2/1973 | Rasmussen | 493/464 |
| 3,799,039 | 3/1974 | Johnson | 493/967 |
| 4,026,198 | 5/1977 | Ottaviano | 493/967 |
| 4,085,662 | 4/1978 | Ottaviano | 493/967 |
| 4,109,040 | 8/1978 | Ottaviano | 493/967 |
| 4,237,776 | 12/1980 | Ottaviano | 493/967 |
| 4,355,437 | 10/1982 | Wright | 452/21 |
| 4,650,456 | 3/1987 | Armington | 493/967 |
| 4,717,613 | 1/1988 | Ottaviano | 493/967 |
| 4,750,896 | 6/1988 | Komaransky | 493/967 |
| 4,884,999 | 12/1989 | Baldacci | 493/967 |
| 4,968,291 | 11/1990 | Baldacci | 493/464 |
| 5,188,581 | 2/1993 | Baldacci | 493/439 |
| 5,211,620 | 5/1993 | Ratzel | 493/967 |
| 5,254,389 | 10/1993 | Tether | 493/967 |
| 5,340,638 | 8/1994 | Sperner | 493/967 |
| 5,403,259 | 4/1995 | Parker | 493/352 |
| 5,439,730 | 8/1995 | Kelly | 493/967 |

*Primary Examiner*—Scott A. Smith
*Assistant Examiner*—Christopher W. Day
*Attorney, Agent, or Firm*—Abelman, Frayne & Schwab

[57] ABSTRACT

A machine and method for making cushioning dunnage products by crumpling paper as well as the produced dunnage product is disclosed. The dunnage product is produced from multi-ply paper-like material in which the lateral edges are folded back, and the material is then driven, crumpled, and connected by successive compressions. The folding, crumpling and connecting operations are formed independent of each other in successive steps. By separating the steps, perforations or tearing is avoided, thereby permitting the use of less expensive raw materials, such as recycled paper, rather than the more expensive high quality kraft paper.

14 Claims, 3 Drawing Sheets

MACHINES AND METHODS FOR MAKING CUSHIONING DUNNAGE PRODUCTS BY CRUMPING PAPER

TECHNICAL FIELD

This invention relates as indicated to improvements to the machines and methods for making cushion dunnage products from a multi-ply paper-like material, the sheets of which are folded and then fed into a crumpling/crinkling device. The invention relates also to a new structure of this product and a new method for making it.

BACKGROUND OF THE INVENTION

Machines of this type have existed for a long time. Thus, U.S. Pat. No. 3,603,216, filed in 1968, describes a machine in which a multi-ply paper-like material is guided firstly in a converging chute which is a truncated pyramid in shape and which becomes thinner downstream so that the longitudinal edges of the material are folded perpendicularly to the axis, and then secondly in a gear assembly between which the material travels. The central band of the resulting strip is grabbed by the teeth of the gears and pulled downstream as it is nipped by these gears. The material is simultaneously compressed or coined, and the various layers are pressed together forming the coined strip. The product made by the machine comprises consequently a central coined strip and two pillow-like edges, and is suitable for padding shipping cases or boxes.

The main characteristic of this type of machine is that the same gears simultaneously pull the paper-like material downstream, and crumple and coin the multi-ply strip to connect the inwardly rolled edges to the central strip.

In practice, this plurality of functions can cause problems, these have been solved by various solutions, none of which is entirely satisfactory. Thus, when the pressure exerted on the sheets is sufficient to pull them downstream, the said sheets sometimes get torn up. On the other hand, if the pressure is reduced, the central strip is not held together firmly enough and sometimes the pillow-like edges come open, thus the material can consequently not be used as a cushioning dunnage product.

One of the proposed solutions to reconcile the two above requirements is described in patent No. EP-A-0 427 834 and is a gear-like stitching assembly having gear like members disposed in a meshed condition, characterized in that the teeth of at least one of the gear-like members have projections thereon for perforating the multi-ply formed material along the central coined section of the produced pad like cushioning dunnage product.

However, the central coined area becomes more fragile, particularly where the projections of the teeth have made perforations, which are in fact beginnings of tears. The described machine can then only be used with superimposed sheets of high quality kraft paper, which is also much more expensive.

SUMMARY OF THE INVENTION

The present invention provides a machine of a very different design without the aforementioned drawbacks, with a combination of means for producing a cushioning dunnage product of the same type as the aforementioned product, but with much higher cohesion. The product is made of recycled paper, much cheaper than the preceding paper, without risk of tearing it up.

The machine performs the functions of pulling downstream the paper-like strip, crumpling and connecting it, in order to make a high cohesion product, said functions being provided by separated parts, each one being adapted to the functions to be performed, and thus ensuring total efficiency of the machine.

The components provided for the pulling downstream are two superimposed wheels, with a cylindrical shaped upper wheel, called the pulling wheel. The median portion of this pulling wheel includes an annular groove, while the edge portions are milled, these edges include flat parts along their periphery, located so that the flat parts of one edge portion face the non flattened parts of the other edge portion. The lower wheel, called the support wheel, and having also an approximately cylindrical shape, includes a median portion with a toric strip corresponding to the annular groove of the upper wheel, and two cylindrical edge portions in contact with the non flattened areas of the upper wheel.

As described further in more detail, the superimposed sheets of the multi-ply formed material are nipped and driven between the cylindrical portions of the lower wheel and the non flattened parts of both the edge portions of the upper wheel, i.e. alternately the right and the left edge portions. The sheets are consequently not pulled downstream axially, but alternately by the left portion and by the right portion, with respect to the central axis, the resulting lateral dissymetry being balanced by the median hollow flexible area created between the toric strip and the annular groove. Due to this driving mode, the efforts exerted on the sheets do not result in tearings thereon, because of the lack of stresses, except the stress for the axial pulling downstream.

The components performing the connection of the superimposed sheets consist in another set of two wheels, the upper wheel being castellated and the lower wheel being smooth, the periphery of the teeth rotating on the smooth surface, and the superimposed sheets being then compressed by the teeth acting against the support wheel. There are no risks of tearing, because the sheets are not deformed between gear like members meshing together.

The means performing the crumpling operation comprise a reducing gear assembly linking the pulling wheels (at the rear) and the connecting wheels (at the fore) so that the said pulling wheels rotate 1.9 times quicker than the connecting wheels. Due to the difference of speed, the material feeds into the connecting wheels quicker than the rotation of said wheels, and is compressed and crumpled without stresses.

There is consequently a combination of means and results, acting from rearward to forward, between the driving wheels, the reducing gear assembly and the connecting wheels, in order to make the final product, i.e. a pad like product having a high cohesion, without risking any tearings.

This new design, contrary to the usual designs for this kind of machine, allows the use of paper of inferior quality, less expansive than kraft paper, for instance recycled paper of poor quality, which would not be possible in the typical machines mentioned above.

The present invention relates also to several improvements for the system described above.

Thus, whereas it is well-known in the previous machines to mount the two gear-like members for pulling and connecting the material with spring means coacting with the said members for urging them toward one another, the invention relates to an important modification to these systems.

Due to the fact that the driving is performed only by the rear wheels, while the connecting wheels do not exert a high pressure, it is possible to mount the axis of the lower wheels on rocking levers upon which act springs positioned so that the actions of said springs are stronger rearward (for the driving function) than forward (for the connecting function). In practice, the whole mechanical system is mounted in a cradle having fixed upper axes and a fixed reducing gear assembly linking them, whereas the lower axes are placed along a rocking lever rotating backwards and forwards, and coacting with a set of two springs exerting pressure on a point of the rocking lever located between the rear end and the front end, at about a distance of ⅓ from the rear end.

The invention relates also to a simplified system provided for feeding the machine in paper, ensuring an optimization of the quantity of material being fed into the whole mechanical system, which will be described hereinafter.

The present invention relates also to a method for making cushioning dunnage product from a multi-ply formed paper-like material, after having folded back the lateral edges on the central portion, by pulling said material downstream, crumpling it transversally, and compressing it along successive areas to maintain it. The main characteristic of the said method is that all of the previous steps are made successively and separately. Preferably, the crumpling is the consequence of the braking of the material downstream of the driving stage, without any additional means acting directly on the material.

Lastly, the invention relates to a new cushioning dunnage product resulting from the above method, having a sufficient dunnage because of the crumpling and an excellent cohesion because of the connecting and of the compression, but being without weak areas; it is therefore possible to make it out of recycled paper, in particular.

The present invention provides these and other features hereinafter fully described and particularly presented in the claims, the following description and annexed drawings showing in detail particularly a preferred embodiment.

BRIEF DESCRIPTION OF THE DRAWINGS

In the annexed drawings.

DESCRIPTION OF THE PREFERRED EMBODIMENT

Figure 1:
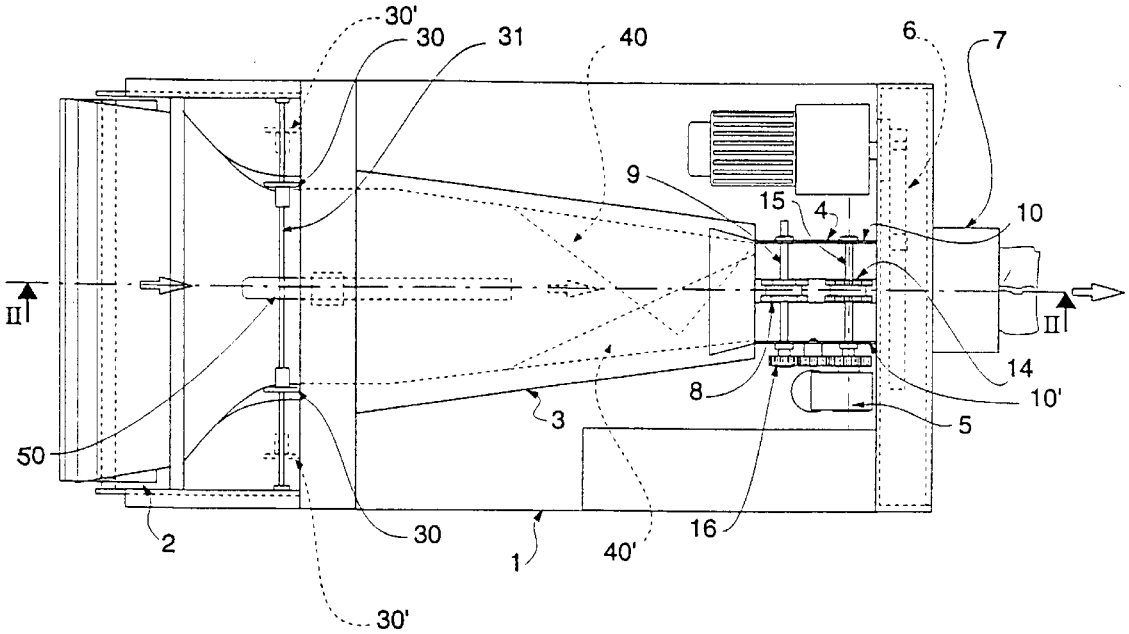
FIG. 1 is a top plan view of the machine according to the invention, including the sheet-like material.

In this drawing, all the usual components of a traditional cushioning dunnage machine are represented: at least one roll 2 of superimposed sheet-like paper supported by a frame 1, a converging chute 3 which is shaped like a truncated pyramid horizontally oriented forwards, driving components, crumpling and compression components mounted in a cradle 4 and driven by a motor 5, a cutting device 6 and a tunnel-like element 7 for extracting the product.

Figure 4:
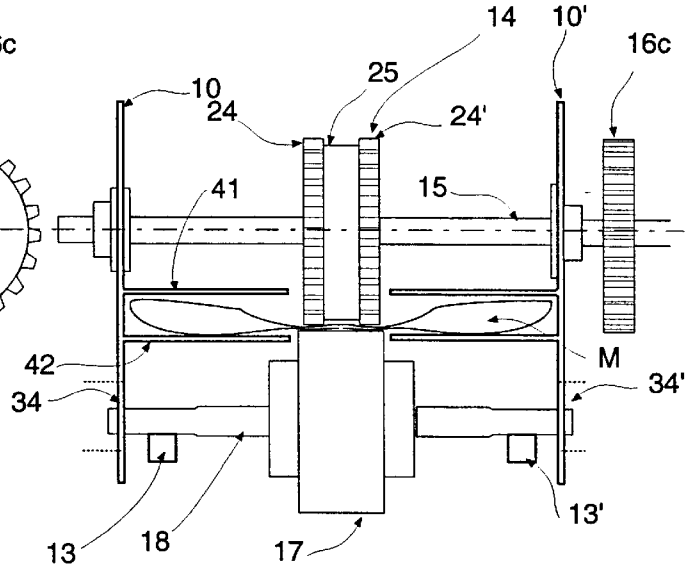
FIG. 4 is a sectional transversal view according to the axes of the connecting wheels, as seen along line IV—IV in FIG. 2.
Figure 3:
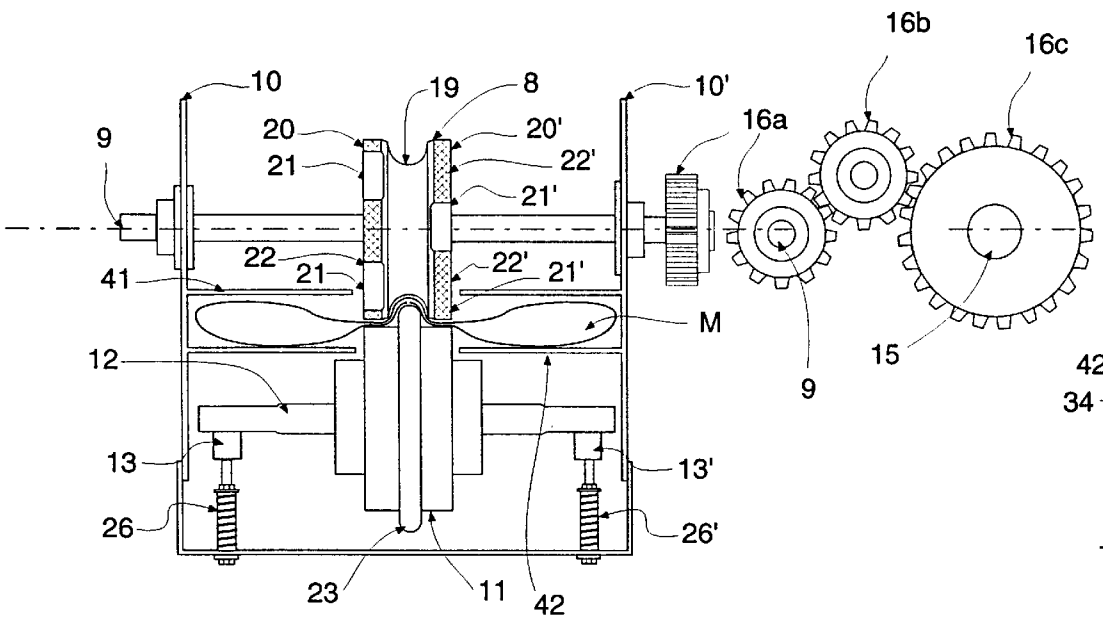
FIG. 3 is a sectional transversal view according to the axes of the driving wheels, as seen along line III—III in FIG. 2.
Figure 5:
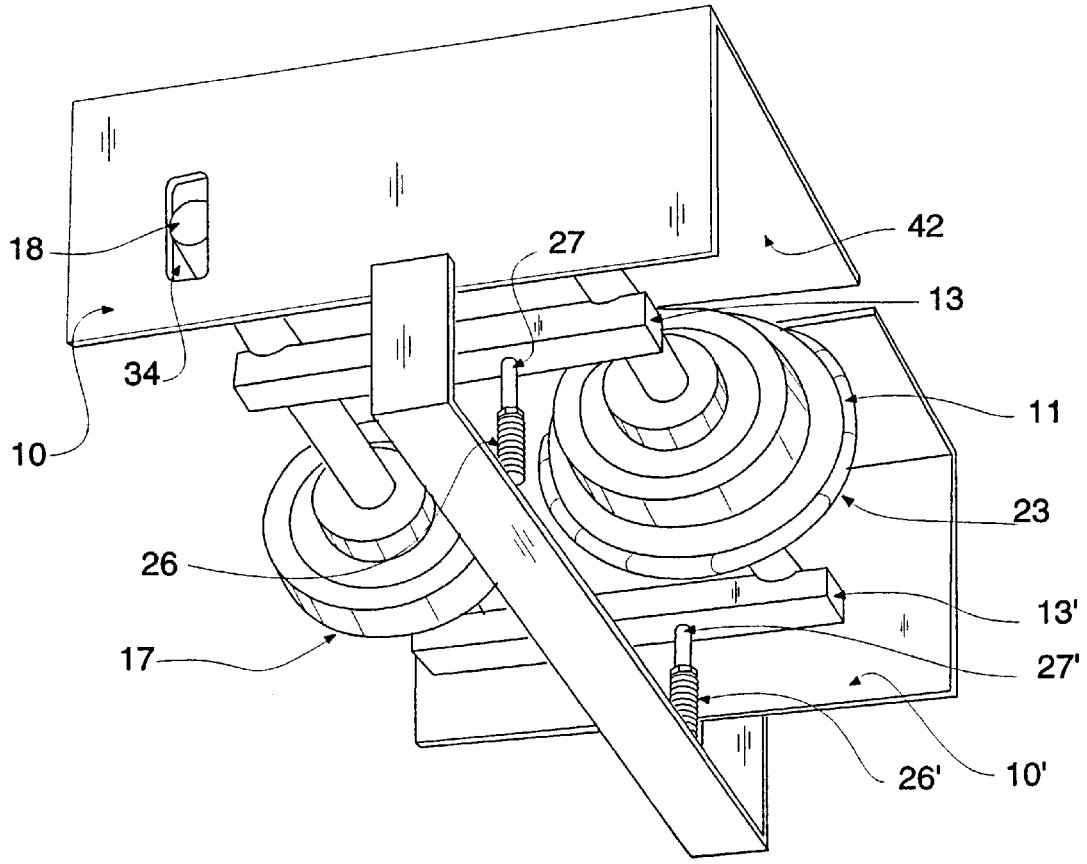
FIG. 5 is a partial perspective view of the cradle in which is mounted the mechanical system, seen from the bottom, the upper wheels being removed.

The invention consists essentially in the design and the making of the mechanical system included in the cradle 4, whose various components and arrangement, are clearly represented in the FIGS. 3–5.

The system comprises a first set of two superimposed wheels (FIG. 3), the upper or driving wheel 8 rotating on an axis 9 mounted on lateral flanges 10-10' of the cradle 4, the lower support wheel 11 rotating around an axis 12 supported by a lever 13. This lever is mounted in such as way as to rock in a flexible manner in relation with the cradle 4 as represented in the FIG. 5, and described in more detail further in the text.

The same mechanical system further includes a second set of two superimposed wheels (see FIG. 4), the upper wheel or compression wheel 14 rotating on an axis 15 mounted in lateral flanges 10, 10' and driven by the motor 5, the lower support wheel 17 rotating on an axis 18 also supported by the lever 13 rocking in a flexible manner in relation to the cradle 4.

In the represented embodiment, both the axes 9 and 15 are driven by the motor 5, i.e. directly for the axis 15 and by means of the reducing assembly gear comprising the gear-like members referred to as 16*a,* 16*b,* 16*c* for the axis 9 (see FIGS. 3 and 4).

The structure and the functions of the two sets of wheels are the following:

As seen in the FIG. 3, the driving or pulling wheel 8 is approximately cylindrical, with a central portion 19 provided with an annular groove having a semi-circular section, and two edge portions 20, 20' having a cylindrical periphery regularly interrupted by flat parts or areas 21. The latter areas present the following characteristics: the flat parts 21 of the edge portion 20 face cylindrical areas 22' of the edge portion 20', whereas the flat parts 21" of the edge portion 20' face cylindrical areas 22 of the edge portion 20.

The support wheel 11 coacting with the driving wheel 8 is also cylindrical, but includes in its median portion a toric strip 23, having a section corresponding to the hollowed section of the annular groove of the wheel 8.

The multi-ply formed material M issued from the converging chute 3, consisting in superimposed sheets folded back on themselves, passes between the wheels 8 and 11, and is pulled downstream by the driving wheel 8. As represented in FIG. 3, the material M is nipped with varying force, as explained hereinafter, on the support wheel 11, when coming into contact with the cylindrical areas 22, 22' of the edge portions 20, 20', but becomes free when the flat parts 21, 21' pass in front. Due to the staggering of the flat parts of the two edge portions 20, 20', the band M is driven alternately by the two edge portions, on both sides with respect to the longitudinal axis. The material is consequently not pulled uniquely axially a, process which can result in tearings in the central strip.

The movement resulting from successive nippings on one side or on the other results in the creation of an excess of paper in the central strip, the said excess being generated by the toric strip 23 inserted in the groove 19, and increasing the possibility of crumpling.

This driving or pulling mode of the present invention is new and is a part of the invention.

Referring now to the FIG. 4, the compression wheel 14 is approximately cylindrical and includes two ridged edge-portions 24, 24' connected by a smooth median portion 25. The support wheel 17 is a smooth cylindrically-shaped wheel on the periphery of which the ribs 24, 24' rotate. The material M, issued from the first set of wheels 8, 11 is tightened between said ribs and the smooth surface, with a varying pressure, as described hereinafter. However, the compression is limited, in order to avoid damage to the material, since the latter is not deformed between the teeth of the gear-like members as in the previous systems. The ribs 24, 24', coacting with the material, ensure by the compression the connection of the several layers of said material and the cohesion of the product, by flattening out the pleats of the paper.

An essential particularity of the second set of wheels is that it performs only the connecting function, but does not participate in the driving function (on the contrary, the second set brakes the movement).

As represented in FIG. 5, the lever 13, 13' supporting the axis 12, 18 of the wheels 11, 18 coacts with the springs 26, 26' exerting a pressure on a point 27, 27' located nearer the rear end of said lever, i.e. nearer the axis 12 than the front part (axis 18). The exerted force is consequently distributed so that the pressure exerted by the wheel 11 is greater than the pressure exerted by the wheel 17. The difference is explained by the fact that the wheel 11 coacts with the driving wheel 8, and must consequently nip the multi-ply formed band M proportionally stronger than the wheel 17, which is only a support for the ribs 24, 24'.

The ratio of the forces can be of ⅓–⅔, or can be chosen differently if desired, in modifying the location of the points 27, 27'.

The connecting function and the adjustment mode of this function with respect to the driving function are also new and a part of the invention.

Lastly, according to another essential characteristic of the present invention, the crumpling function is not operated by gear-like members as in the previous devices, but by a mechanical system which does not affect the solidity of the material.

As it is symbolically suggested by the diagrammatical representation of the gears 16*a* and 16*b*, 16*c* (forming a reducing gear assembly between the FIGS. 3–4), the motor 5, driving the wheel 14, drives also the wheel 8 which rotates in the same direction but quicker than the preceding wheel. As a result, the folded band M, when leaving the set of wheels 8–11, is nipped by the wheels 14–17 rotating slower. The material is then squeezed between the two sets of wheels, thus permanently creating transverse pleats, referred to as P in the FIG. 2. The function of crumpling of the material M is performed by the difference of rotating speeds of the two sets of wheels, as the driving couple rotates quicker than the connecting couple. After experimentation, the preferred speed ratio chosen is 1,9. That can be for instance obtained by gears 16*a*, 16*b* provided with 20 teeth, whereas the gear 16*c* is provided with 38 teeth, the gear 16*b* only giving the same rotation direction to the gear 16*c* and then to the wheel 14 as the gear 16*a*.

Of course, this speed ratio can be adapted under other circumstances, for example to obtain the desired crumpling degree. This ratio is calculated for wheels 8–14 having the same diameter, but can also be changed for wheels of different diameters.

The main advantage of this characteristic is that, on the contrary to the previous devices, the crumpling of the material can be considered as "spontaneous", that without further operations of elements able to damage said material, such as the gear-like members as mentioned in the prior art, for example in U.S. Pat. No. 4,968,291, issued Nov. 6, 1990, such gear-like members can cause beginnings of tearings thus restricting the use of such devices only for high quality papers. On the contrary, the machine of the invention can work with ordinary quality papers, as for example recycled papers of lower quality.

Figure 2:
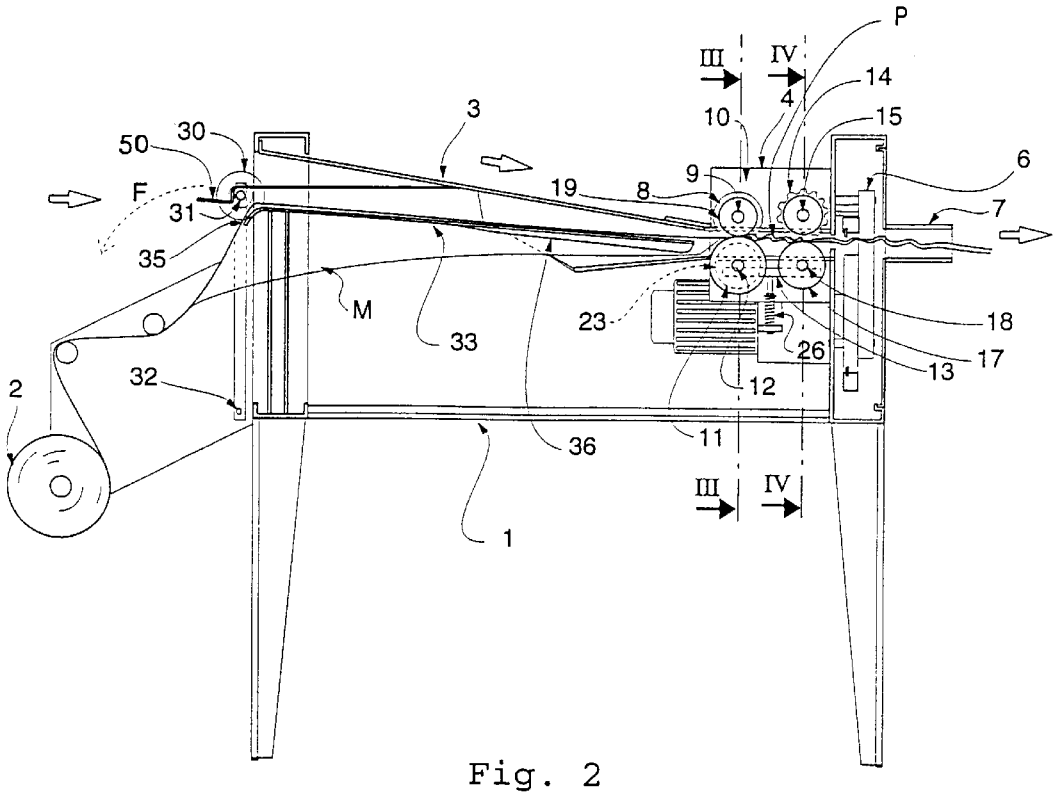
FIG. 2 is a vertical sectional longitudinal view as seen along line II—II in FIG. 1.

As illustrated especially in FIG. 2, the product is made of paper issued from the roll 2, and passing through a guiding system folding the lateral edges on the central strip by mean of a simple and efficient system.

The latter includes firstly a couple of pulleys 30 provided with flanges, made for example of rubber and adjustably and rotatably mounted on a shaft 31, rocking around two arms pivoting around axis 32 according to the direction of the arrow F (see FIG. 2). Thus, the access to the converging chute 3 can be freed in order to facilitate the loading of the paper-like material issued from roll 2. In this position, the pulleys 30 can be axially adjusted until the desired spacing is reached, for instance a predetermined spacing referred to as 30' can be selected, thus the pulleys can be adapted to the several qualities of used paper, which must be folded back according to different radii of curvature in the converging chute 3.

When the paper is inside said converging chute 3, the system 30–31 is lifted up again by rocking it around 32 in a direction opposite to the arrow F, until reaching a vertical orientation (see FIG. 2). In this position, the flanges facilitate the folding of the longitudinal edges of the multi-ply strip in order to roll up said edges around a plate 33 placed inside the converging chute 3. Outside, downstream of the converging chute 3, and once the multi-ply material has been rolled on itself and also around the said plate 33 as described above, it is then nipped by the driving set of two wheels 8/11 in the cradle 4.

The bottom of the converging chute 3 is made of two metal sheets 40, 40' obliquely cut in order to guide the lateral edges of the paper-like material during the folding operation.

The upper and lower plates of the said converging chute 3 extend in 41 and 42, on each side of the sets of wheels 8/11 and 14/17, so that the multi-ply material is fully guided until it reaches the cutting device.

Plate 33 comprises a rear rounded portion 35 for receiving the band on its upper surface. The front portion of said plate 33 includes vertical triangular edge-portions 36 intended to give additional volume to the edge-portions of the cushioning dunnage product formed by the folding of the material M inside the converging chute 3.

A spring 50 is fixed on the rear portion of the upper wall of the converging chute 3 for maintaining the flanges 30 against the rounded portion 35 when the machine is working. This solution replaces all of the complicated devices equipping the previous machines, and is a part of the invention.

The invention concerns, of course, each step characterising the method, which is new in itself, and claimed independently as being original. But the best results obtained by the machine of the invention are obtained by combining two or more of these steps.

It is the same for all the characteristic components of the machine, which are claimed independently and in combinations. The invention also concerns all of the steps or components which are equivalent to those above described as a possible example.

I claim:

1. A method for making cushioning dunnage from an elongated web of stock material having lateral edges and a longitudinal axis said method comprising the steps of:

driving the web in a longitudinal direction;

inwardly folding the lateral edges of the web about the longitudinal axis to form a tubular web having first and second longitudinal sides;

crumpling the folded web in the longitudinal direction alternatingly on first one side of the longitudinal axis of the folded web and then on the other side of the longitudinal axis of the folded web; and compressing the crumpled folded sheet.

2. A method for making cushioning dunnage from an elongated web of stock material having lateral edges and a longitudinal axis said method comprising the steps of:

driving the web in a longitudinal direction;

inwardly folding the lateral edges of the web about the longitudinal axis to form a tubular web having first and second longitudinal sides;

crumpling the folded web in the longitudinal direction by forming pleats alternatingly on first one side of the longitudinal axis of the folded web and then on the other side of the longitudinal axis of the folded web; and connecting the pleats by compressing the pleats through the thickness of the pleated folded tubular web.

3. The method of claim 2 wherein the driving step and the connecting step are separate steps performed on the web successively and independently of one another.

4. The method of claim 2 wherein the driving step is performed at a driving stage, the crumpling step occurs at a crumpling stage and the connecting step is performed at a connecting stage, and wherein the crumpling step at the crumpling stage occurs by virtue of the longitudinal speed of the folded web at the driving stage being greater than the longitudinal speed of the folded web at the connecting stage.

5. Apparatus for making cushioning dunnage from an elongated web of stock material having lateral edges and a longitudinal axis, said apparatus comprising:

a folding assembly for inwardly folding the lateral edges of the web about the longitudinal axis to form a tubular web having first and second longitudinal sides;

a driving assembly operating to drive said tubular web at a first speed in a longitudinal direction and alternatingly driving the first and second longitudinal sides of said tubular web;

a connecting assembly operating to simultaneously connect and drive said tubular web at a second speed in the longitudinal direction, said second speed being less than said first speed;

said driving and connecting assemblies cooperating to form a crumpling operation for crumpling the folded tubular web in the longitudinal direction to form respective pleats in the folded tubular web;

said connecting assembly connecting the pleats by compressing the pleats through the thickness of the pleated folded sheet.

6. The apparatus of claim 5 wherein said folding assembly includes a plate around which the web is folded and a guide structure for inwardly folding the lateral edges of the web around the plate to form the tubular web.

7. The apparatus of claim 5 wherein said driving assembly comprises:

a pair of first and second superimposed wheels;

a first wheel of said pair being generally cylindrically shaped having a median portion provided with an annular groove, said median portion flanked on either side by first and second edge portions, each of said first and second edge portions including alternating flat portions and knurled portions, said flat portions of said first edge portion corresponding to said knurled portions of said second edge portion and said knurled portions of said first edge portion corresponding to said flat portion of said second edge portion;

the second wheel of said pair being generally cylindrically shaped and having a toric strip aligned in said groove of said first wheel, said toric strip flanked on either side by a pair of cylindrical edge portions which cooperate with said knurled portions to alternatingly drive said first and second longitudinal sides of said tubular web.

8. The apparatus of claim 5 wherein said connecting assembly comprises:

a pair of first and second superimposed wheels;

a first wheel of said pair being generally cylindrically shaped and having a plurality of transverse ribs therearound;

the second wheel of said pair being cylindrical and having a smooth surface therearound, said smooth surface cooperating with said ribs to connect said pleated folded sheet.

9. The apparatus of claim 5 wherein said driving and connecting assemblies comprise:

a first pair of first and second superimposed wheels, a first wheel of said first pair being generally cylindrically shaped having a median portion provided with an annular groove, said median portion flanked on either side by first and second edge portions, each of said first and second edge portions including alternating flat portions and knurled portions, said flat portions of said first edge portion corresponding to said knurled portions of said second edge portion and said knurled portions of said first edge portion corresponding to said flat portion of said second edge portion;

the second wheel of said first pair being generally cylindrically shaped and having a toric strip aligned in said groove of said first wheel, said toric strip flanked on either side by a pair of cylindrical edge portions which cooperate with said knurled portions to alternatingly drive said first and second longitudinal sides of said tubular web; and a second pair of superimposed wheels, a first wheel of said second pair being generally cylindrically shaped and having a plurality of transverse ribs therearound;

a second wheel of said second pair being cylindrical and having a smooth surface therearound, said smooth surface cooperating with said ribs to connect said pleated folded sheet.

10. The apparatus of claim 9 wherein said superimposed wheels of said first and second pairs of superposed wheels are spring biased toward each other.

11. The apparatus of claim 10 wherein said first pair of superimposed wheels are spring biased toward one another with a first force and said second pair of superimposed wheels are spring biased toward one another with a second force, said first force being greater than said second force.

12. The apparatus of claim 11 wherein one of the wheels of each of said first and second pairs of superposed wheels are supported on a pair of rocking levers each of which levers is supported on a compression spring.

13. The apparatus of claim 12 wherein said compression springs are spaced from the first pair of superposed wheels about one-third of the distance between said first pair of superposed wheels and said second pair of superposed wheels.

14. Apparatus for making cushioning dunnage from an elongated web of stock material having lateral edges and a longitudinal axis, said apparatus comprising:

a folding assembly for inwardly folding the lateral edges of the web about the longitudinal axis to form a tubular web having first and second longitudinal sides;

a driving assembly operating to drive said tubular web at a first speed in a longitudinal direction and alternatingly driving the first and second longitudinal sides of said tubular web;

a connecting assembly operating to simultaneously connect and drive said tubular web at a second speed in the longitudinal direction, said second speed being less than said first speed;

said driving and connecting assemblies cooperating to perform a crumpling operation for crumpling the folded tubular web in the longitudinal direction;

said connecting assembly compressing the crumpled folded tubular web.

* * * * *